US010746419B2

(12) United States Patent
Sakai et al.

(10) Patent No.: US 10,746,419 B2
(45) Date of Patent: Aug. 18, 2020

(54) HUMIDIFIER AND AIR-CONDITIONING APPARATUS

(71) Applicant: Mitsubishi Electric Corporation, Chiyoda-ku (JP)

(72) Inventors: Takahiro Sakai, Chiyoda-ku (JP); Yasutaka Inanaga, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/072,250

(22) PCT Filed: Feb. 9, 2016

(86) PCT No.: PCT/JP2016/053822
§ 371 (c)(1),
(2) Date: Jul. 24, 2018

(87) PCT Pub. No.: WO2017/138095
PCT Pub. Date: Aug. 17, 2017

(65) Prior Publication Data

US 2019/0032934 A1 Jan. 31, 2019

(51) Int. Cl.
*F24F 6/04* (2006.01)
*F24F 6/00* (2006.01)

(52) U.S. Cl.
CPC ..... *F24F 6/04* (2013.01); *F24F 2006/008* (2013.01)

(58) Field of Classification Search
CPC ..... F24F 6/04; F24F 2006/046; F24F 6/08; F24D 19/0082
See application file for complete search history.

(56) References Cited

U.S. PATENT DOCUMENTS 654,725 A * 7/1900 Gardner ..... F24F 6/04 261/103
684,217 A * 10/1901 Gardner ..... F24F 6/04 261/103

(Continued)

FOREIGN PATENT DOCUMENTS

CN 2169071 Y 6/1994
CN 105143777 A 12/2015

(Continued)

OTHER PUBLICATIONS

EPO translation of Tomoyuki et al. JP2014202397 published Oct. 27, 2014 (Year: 2014).*

(Continued)

*Primary Examiner* — Stephen Hobson
(74) *Attorney, Agent, or Firm* — Xsensus LLP

(57) ABSTRACT

When mineral components such as calcium carbonate and magnesium are contained in humidifying water and a humidification plate has holes and high humidifying efficiency, scales may be locally generated at an end or vicinities of the holes on a windward side. When minute voids in the humidification plate are clogged due to the scales, water absorption capability at a scale generation region is significantly reduced. A problem can arise requiring to replace the humidification plate even when a region other than the end and the vicinities of the holes is satisfactory, whereby replacement cycles are shortened. To address the problem, plural openings in a plate thickness direction are distributed on a flat plate surface of a water absorbing humidifying material. Thus, in an airflow direction of air sent from end sides of the water absorbing humidifying material, opening areas of the plural openings on one end side are increased.

7 Claims, 8 Drawing Sheets

(56) References Cited

U.S. PATENT DOCUMENTS 1,283,950 A * 11/1918 Stiefel ..... F24F 6/04 261/103
1,903,250 A * 3/1933 Tenney ..... F24F 6/04 165/229
1,965,255 A * 7/1934 Peabody ..... F24F 6/04 261/30
2,099,009 A * 11/1937 Finley ..... F24D 19/0082 261/103
2,161,834 A * 6/1939 Seeley ..... F24D 19/0082 237/78 R
2,204,016 A * 6/1940 Karlson ..... F24F 3/14 236/44 C
2,251,734 A * 8/1941 Fuld ..... E03D 9/04 261/73
2,326,089 A * 8/1943 Wittman ..... F24D 19/0082 261/70
3,378,238 A * 4/1968 Babington ..... F24F 6/04 261/26
3,523,681 A * 8/1970 Jaye ..... F24F 6/04 261/142
3,722,838 A * 3/1973 Swimmer ..... F24F 6/04 261/72.1
3,748,828 A * 7/1973 Lefebvre ..... B01D 1/14 95/64
4,389,352 A * 6/1983 Bohanon, Sr. ..... F24F 6/04 261/106
5,226,935 A * 7/1993 Wolff ..... B05B 17/085 239/193
5,624,610 A * 4/1997 Yokoya ..... F24F 3/1417 261/104
6,474,628 B1 * 11/2002 Stroh ..... F24F 6/04 261/107
6,550,748 B2 * 4/2003 Stanek ..... F24F 6/00 261/26
6,669,626 B1 * 12/2003 McDonough ..... A61G 11/00 600/22
9,555,198 B2 * 1/2017 Yang ..... A01M 1/2077
2005/0133942 A1 * 6/2005 Schuld ..... F24F 6/043 261/106
2006/0162368 A1 * 7/2006 Boland ..... F24F 5/0035 62/310
2007/0257384 A1 * 11/2007 Sung ..... C10J 1/24 261/119.1
2008/0152973 A1 * 6/2008 Mogi ..... H01M 8/241 429/413
2009/0000620 A1 * 1/2009 Virr ..... A61M 16/142 128/203.27
2010/0207286 A1 * 8/2010 Jursich ..... F24F 6/043 261/102
2010/0313580 A1 * 12/2010 Morioka ..... B05B 5/16 62/78
2012/0267804 A1 * 10/2012 Rodrigs ..... F24F 6/04 261/64.1
2013/0106004 A1 * 5/2013 Stumphauzer ..... F24F 6/04 261/128
2013/0186611 A1 * 7/2013 Schneider ..... F24F 11/0008 165/226
2013/0213076 A1 * 8/2013 Gerlach ..... F24F 5/0035 62/314
2013/0284169 A1 * 10/2013 Foote ..... A61M 16/0833 128/203.14
2013/0313729 A1 * 11/2013 Sakai ..... F24F 6/025 261/130
2015/0153052 A1 * 6/2015 Saito ..... F24F 11/0008 261/128
2015/0219346 A1 * 8/2015 Morikawa ..... F24F 3/14 261/136
2016/0040897 A1 * 2/2016 Sakai ..... F24F 13/08 261/101
2016/0146483 A1 * 5/2016 Sakai ..... F24F 6/025 62/176.4
2016/0251521 A1 * 9/2016 Izutani ..... C09D 7/43 261/101

FOREIGN PATENT DOCUMENTS

GB 690737 A 4/1953
JP 3-230037 A 10/1991
JP 4-320743 A 11/1992
JP 6-32922 U 4/1994
JP 7-269915 A 10/1995
JP 2007-255808 A 10/2007
JP 2007255808 * 10/2007
JP 2008-103115 A 5/2008
JP 2008-202827 A 9/2008
JP 2011-62816 A 3/2011
JP 2012-13247 A 1/2012
JP 2012-93059 A 5/2012
JP 2014202397 * 10/2014
WO WO-2014174867 A1 * 10/2014

OTHER PUBLICATIONS

EPO translation of Masaaki et al. JP2007255808 published Oct. 4, 2007 (Year: 2007).*
EPO translation of Takahiro et al. WO2014174867 published Oct. 30, 2014 (Year: 2014).*
Combined Office Action and Search Report dated Jan. 14, 2019 in Chinese Patent Application No. 201680080235.3, 12 pages (with English translation of the Office Action and English translation of category of cited documents).
International Search Report dated May 10, 2016 in PCT/JP2016/053822 filed Feb. 9, 2016.
Japanese Office Action dated Aug. 15, 2016 in JP 2016-543211 (with English translation), 7 pages.
Chinese Office Action dated May 22, 2019 in Chinese Patent Application No. 201680080235.3 (with unedited computer generated English translation), 8 pages.
Chinese Office Action dated Aug. 27, 2019 in Patent Application No. 201680080235.3 (with English translation). 10 pages.
German Office Action dated Oct. 4, 2019 in Patent Application No. 11 2016 006 379.2 (with English translation), 8 pages.

* cited by examiner

HUMIDIFIER AND AIR-CONDITIONING APPARATUS

TECHNICAL FIELD

The present invention relates to a humidifier and an air-conditioning apparatus.

BACKGROUND ART

To provide appropriate humidity is an important factor for providing a comfortable indoor air atmosphere. When the humidity is deficient, there may be caused adverse influences such as human health hazard, deterioration of objects, and generation of static electricity. To provide appropriate humidity, for example, in the Building Sanitation Control Act, it is determined that, in specific buildings such as commercial facilities and offices having floor areas of 3,000 $m^2$ or more, the temperature is required to be maintained at 17 degrees Celsius to 28 degrees Celsius, and the relative humidity against the temperature is required to be maintained at 40% to 70% as control standard values for the air environment. Further, in American Society of Heating, Refrigerating and Air-Conditioning Engineers (ASHRAE), it is clearly specified that the relative humidity is from 30% to 60% as a humidity criterion.

As an indoor space humidification method of humidifying an indoor space, there has been known an evaporative method. The evaporative method is a method of performing humidification by preparing a water absorbing humidifying material having water absorption capability, supplying water to the water absorbing humidifying material, and causing air to pass through the water absorbing humidifying material. When the air is caused to pass through the water absorbing humidifying material, the water contained in the water absorbing humidifying material is subjected to heat exchange with an air current, to thereby cause vaporization and evaporation. In this manner, the indoor space is humidified (for example, Patent Literature 1 and Patent Literature 2).

CITATION LIST

Patent Literature

Patent Literature 1: Japanese Unexamined Patent Application Publication No. 3-230037 A Patent Literature 2: Japanese Unexamined Patent Application Publication No. 2012-93059

SUMMARY OF INVENTION

Technical Problem

When mineral components are contained in the water to be supplied to the water absorbing humidifying material having water absorption capability, these mineral components react with carbon dioxide, so that a sparingly soluble substance that is hardly soluble to the water may be generated. The sparingly soluble substance thus generated deposits and transforms along with the vaporization and evaporation, and precipitates as scales.

Tap water is generally used as water to be supplied to the water absorbing humidifying material. However, mineral components, such as calcium carbonate, magnesium, and silica, are contained in tap water, and hence there is a high risk of scale precipitation. When the scales precipitate on the filter, the water absorption capability of the water absorbing humidifying material is degraded, and hence it is required to replace the water absorbing humidifying material.

In an evaporative humidification method for an indoor space, in general, air is caused to pass through the water absorbing humidifying material from one end side to the other end side. In this manner, vaporization and evaporation are promoted. When the air is caused to pass through the water absorbing humidifying material as described above, a vaporization and evaporation rate at a portion on the one end side of the water absorbing humidifying material, onto which the air is directly blown, is extremely larger than a vaporization and evaporation rate at a portion on the other end side of the water absorbing humidifying material.

When the vaporization and evaporation rate at the portion on the one end side of the water absorbing humidifying material is extremely larger than the vaporization and evaporation rate at the portion on the other end side of the water absorbing humidifying material, the scales may precipitate earlier at the portion on the one end side of the water absorbing humidifying material than at the portion on the other end side of the water absorbing humidifying material. When the scales precipitate at the portion on the one end side of the water absorbing humidifying material, the water absorption capability at the portion on the one end side is degraded, and the vaporization and evaporation rate at the portion on the one end side is degraded. As a result, the vaporization and evaporation rate is significantly degraded in the entire water absorbing humidifying material, and, consequently, the humidification performance is degraded. Consequently, when the scales precipitate at the portion on the one end side of the water absorbing humidifying material, it is required to replace the water absorbing humidifying material even when the scales do not precipitate at the portion on the other end side of the water absorbing humidifying material. That is, a replacement cycle of the water absorbing humidifying material is shortened.

The present invention has been made to solve the above-mentioned problems, and has an object to provide a humidifier having an extended replacement cycle of a water absorbing humidifying material to the extent possible, and an air-conditioning apparatus including the humidifier.

Solution to Problem

According to one embodiment of the present invention, there is provided a humidifier including a water absorbing humidifying material having a plate shape, and made of a water absorbing material, a supply unit configured to supply water to the water absorbing humidifying material, and an air-sending device configured to send air from one end side to the other end side of the water absorbing humidifying material in an airflow direction perpendicular to a plate thickness direction of the water absorbing humidifying material. The water absorbing humidifying material has a plurality of openings penetrating through the water absorbing humidifying material, and the humidifier is configured to perform humidification through vaporization and evaporation of the water supplied to the water absorbing humidifying material by the air sent by the air-sending device.

The air-conditioning apparatus according to one embodiment of the present invention includes a heat exchanger configured to subject sent air to heat exchange, and the above-mentioned humidifier. The humidifier humidifies the air subjected to the heat exchange by the heat exchanger. In this manner, the air-conditioning apparatus performs air conditioning.

Advantageous Effects of Invention

In the humidifier and the air-conditioning apparatus according to one embodiment of the present invention, the plurality of openings are distributed on a flat plate surface of the water absorbing humidifying material having a plate shape. The contact area with the air is increased in the openings opened in a plate thickness direction of the water absorbing humidifying material. Consequently, the vaporization and evaporation rate is enhanced. The plurality of openings are cut so that the distribution density is non-uniform in the airflow direction in which the air is sent to the water absorbing humidifying material. Thus, the vaporization and evaporation rate on the other end side opposite to the one end side, on which the air is directly blown, of the water absorbing humidifying material can be increased, and, consequently, the relative vaporization and evaporation rate on the one end side of the water absorbing humidifying material, on which the air is directly blown, can be reduced. As a result, such a situation that the scale precipitation is locally caused on a region on the one end side can be prevented to the extent possible, so that a surface load of the scale precipitation on one surface of the water absorbing humidifying material can be smoothed, and thereby a replacement cycle of the water absorbing humidifying material can be extended to the extent possible.

DESCRIPTION OF EMBODIMENTS

Details of a humidifier and an air-conditioning apparatus according to embodiments of the present invention are described below with reference to the accompanying drawings. The embodiments described below are merely examples, and the present invention is not limited to these embodiments. Still further, in the following drawings, the size relationship among the components sometimes differs from the actual relationship.

Embodiment 1

(Configuration of Humidifier)

Figure 1:
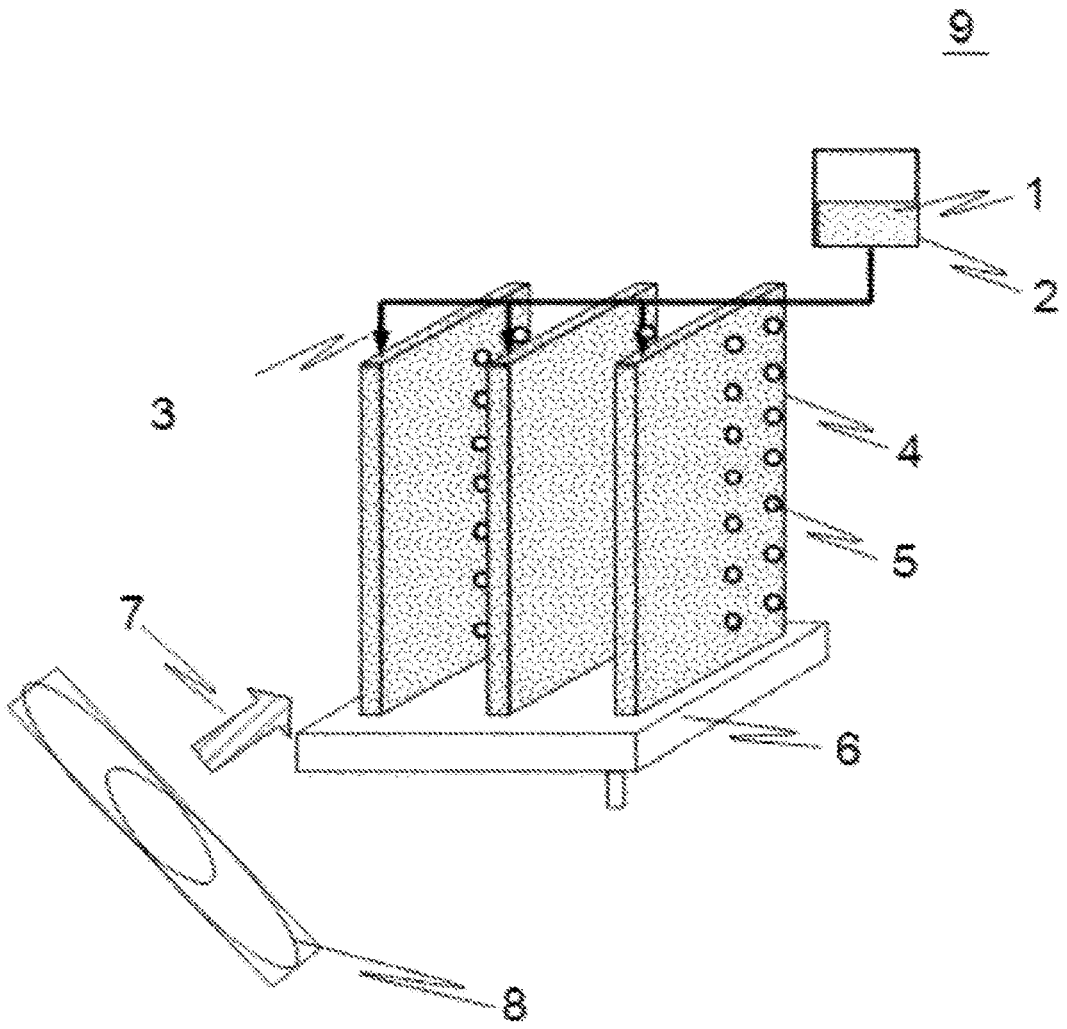
FIG. 1 is a configuration view of a humidifier according to Embodiment 1.

FIG. 1 is an illustration of a humidifier 9 according to Embodiment 1 of the present invention. As illustrated in FIG. 1, the humidifier 9 according to Embodiment 1 includes a supply portion 2, nozzles 3, water absorbing humidifying materials 4, a drain pan 6, and an air-sending device 8.

The supply portion 2 is configured to reserve humidifying water 1 used for humidifying a humidification space to be humidified, and serves as a supply unit configured to supply the humidifying water 1 to the water absorbing humidifying materials 4. The nozzles 3 are each an example of a water supply unit configured to supply the humidifying water 1 from the supply portion 2 to the water absorbing humidifying materials 4. The water absorbing humidifying materials 4 are configured to absorb the humidifying water 1 supplied from the supply portion 2. When air is caused to pass through the water absorbing humidifying materials 4, the absorbed humidifying water 1 is evaporated by vaporization. In this manner, the humidification space is humidified. The drain pan 6 is placed below the water absorbing humidifying materials 4 in a vertical direction, and is configured to receive surplus water from the water absorbing humidifying materials 4.

The water absorbing humidifying materials 4 are each made of a water absorbing material having a plate shape, and a plurality of water absorbing humidifying materials 4 are arrayed in a short axis direction with clearance spaces. In FIG. 1, an example is described in which three water absorbing humidifying materials 4 are arrayed in a horizontal direction and each of the water absorbing humidifying materials 4 is placed upright in the vertical direction. However, it is only required that at least one water absorbing humidifying material 4 is placed upright.

The air-sending device 8 is configured to cause air 7 to flow from one end side to the other end side of the water absorbing humidifying materials 4 in an airflow direction perpendicular to a plate thickness direction and an arraying direction of the water absorbing humidifying materials 4. The airflow direction is different from the vertical direction. The air 7 flows through the clearance spaces between the water absorbing humidifying materials 4 that are adjacent to each other, and thus vaporization and evaporation of the humidifying water 1 absorbed by the water absorbing humidifying materials 4 are promoted.

It is only required that the supply portion 2, the nozzles 3, the water absorbing humidifying materials 4, the air-sending device 8, and the drain pan 6 are each fixed by, for example, a predetermined supporter. A configuration of the supporter is not particularly limited, and only is required to be selected as appropriate depending on the usage of the humidifier 9.

Figure 2:
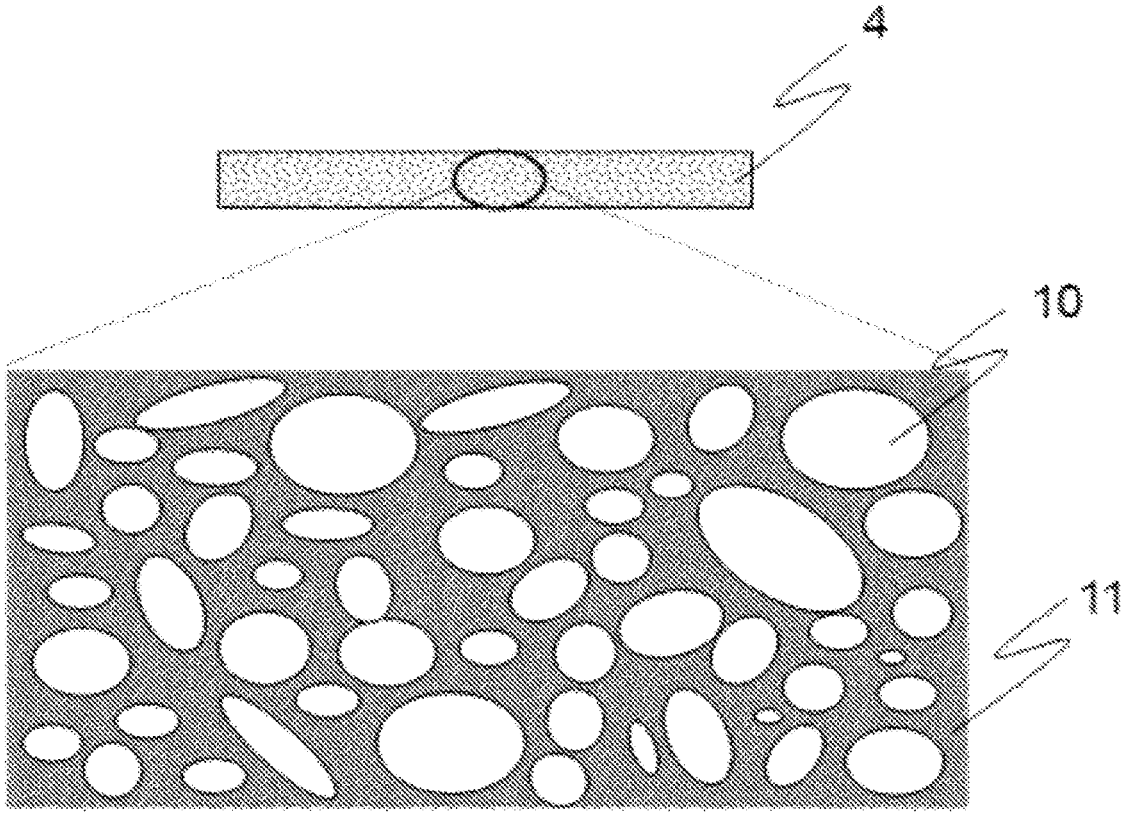
FIG. 2 is a configuration view for illustrating a partially enlarged portion of a water absorbing humidifying material.

FIG. 2 is a partially enlarged sectional view of the water absorbing humidifying material 4. The water absorbing humidifying material 4 has a three-dimensional mesh structure including a body portion 11 and voids 10 opened in the body portion 11, and is formed so that water absorbability is enhanced. The three-dimensional mesh structure refers to a structure similar to a resin foam having high water absorbability such as sponge. It is conceivable that the water absorbing humidifying material 4 of Embodiment 1 be made of a porous material such as a metal, ceramic, resin, non-woven fabric, and fiber, and each of these materials is formed into foam or mesh. However, the material of the water absorbing humidifying material 4 is not limited to these materials.

The humidifying water 1 of Embodiment 1 is used for the purpose of humidifying the space to be humidified, and tap water is used as an example of the humidifying water 1. When mineral components such as calcium carbonate, magnesium, and silica contained in water, such as tap water, react with carbon dioxide, a sparingly soluble substance that is hardly soluble to water is generated. The sparingly soluble substance thus generated are deposited along with the vaporization and evaporation, and are transformed into scales. When such scales are generated in the water absorbing humidifying material 4, there is a fear in that the voids 10 may be clogged to degrade water absorbability. When the water absorbability is degraded, the vaporization and evaporation rate is degraded, with the result that humidification performance is degraded. Consequently, as the humidifying water 1, water containing a small amount of mineral components is preferred, but soft water, hard water, or other water may be used.

The supply portion 2 is configured to reserve the humidifying water 1, and to supply the humidifying water 1 to the water absorbing humidifying materials 4. The supply portion 2 is configured to supply the humidifying water 1 by dripping the humidifying water 1 from the nozzles 3 to a portion above the water absorbing humidifying materials 4 using a drive unit such as a pump. Further, it is only required that the drive unit is capable of transporting the humidifying water 1, and, for example, the drive unit is a non-positive displacement pump or a positive displacement pump, and is not particularly limited. Further, the drain pan 6 to which the humidifying water 1 is supplied from the nozzles 3 may serve as the supply portion 2. There may be employed a configuration in which, for example, one end of each of the water absorbing humidifying materials 4 is provided in the drain pan 6 so that the humidifying water 1 is sucked up by capillary forces of the water absorbing humidifying materials 4 to be supplied.

The nozzles 3 are installed on the portions above the water absorbing humidifying materials 4, which are in regions at which the humidification performance is the highest, and are configured to supply the humidifying water 1 transported from the supply portion 2 by dripping the humidifying water 1 from the portions above the water absorbing humidifying materials 4. Further, the humidifying water 1 may be supplied from the nozzles 3 to the supply portion 2.

The nozzles 3 each have a hollow shape, and the outer diameter and the inner diameter of the nozzle 3 only are required to be selected depending on the size and thickness of the water absorbing humidifying material 4. Further, the distal end of the nozzle 3 may have any shape, such as a triangular pyramid shape, a quadrangular pyramid shape, a circular tube shape, and a square tube shape. In this case, a shape in which the distal end has a triangular pyramid shape and an outlet of the nozzle 3 has a hole diameter of 0.5 mm is preferred. This is because, when the nozzle 3 has an acute distal end, water droplets are well dripped off the nozzle 3. It is preferred that the nozzle 3 have an acute distal end, but when the distal end is excessively acute, the nozzle 3 is difficult to handle and reduced in strength. For this reason, it is preferred that the angle of the distal end fall within a range of from 10 degrees to 45 degrees.

When the hole diameter of the outlet of the nozzle 3 is excessively large, there is a fear in that the humidifying water 1 may be excessively supplied, so that the amount of unrequired water is increased. Meanwhile, when the hole diameter of the outlet of the nozzle 3 is excessively small, the outlet of the nozzle 3 may be liable to be clogged with particles or scales mixed into the humidifying water 1. For this reason, it is preferred that the hole diameter of the nozzle 3 fall within a range of from 0.1 mm to 0.6 mm. Further, a material of the nozzle 3 may be metals, such as stainless steel, tungsten, titanium, silver, and copper, a resin, such as PTFE, polyethylene, polypropylene, or other appropriate materials. In a case in which an inexpensive copper pipe is used as a water discharge pipe to which the nozzle 3 is connected, when polypropylene is used as a material of the nozzle 3, the polypropylene is degraded due to a catalyst action of copper. Consequently, when a resin is selected in such a case, it is preferred to select PTFE or polyethylene.

When the length of the water absorbing humidifying material 4 in the airflow direction (length from the one end side to the other end side of the water absorbing humidifying material 4 in the airflow direction) is large, a plurality of nozzles 3 may be provided for one water absorbing humidifying material 4. For example, when the length in the airflow direction is 60 mm or less, one nozzle 3 may be enough for one water absorbing humidifying material 4. However, when the length in the airflow direction is more than 60 mm, a plurality of nozzles 3 may be provided for one water absorbing humidifying material 4.

It is required that a water supply amount of the humidifying water 1 is larger than a water amount to be used for actual humidification. However, supply of a surplus amount of the humidifying water 1 leads to increase in surplus water. For this reason, it is desired that the water supply amount of the humidifying water 1 be controlled to be an appropriate amount. For example, a case is assumed where the water absorbing humidifying material 4 has a humidification performance per unit area of 2,000 mL/h/m$^2$ and a size of 200 mm×50 mm, and both front and back sides of the water absorbing humidifying material 4 can be humidified. In this case, the humidification amount of the one water absorbing humidifying material 4 is 40 mL/h. Consequently, it is desired that the humidifying water 1 be supplied by an amount within a range of from 60 mL/h to 200 mL/h, which is 1.5 times to 5 times as large as the humidification amount.

When a plurality of water absorbing humidifying materials 4 are provided, the number of the nozzles 3 is increased, and there is a fear in that the water supply amounts from the respective nozzles 3 may become non-uniform. Consequently, a water absorbing material made of a fiber, a resin, or a metal may be provided between the nozzle 3 and the water absorbing humidifying material 4 to be brought into contact with the water absorbing humidifying material 4. Even when the plurality of water absorbing humidifying materials 4 are arranged, the water absorbing materials are provided to be brought into contact with the water absorbing humidifying materials 4, and thereby the humidifying water 1 can be reliably supplied.

The water absorbing humidifying material 4 has, for example, a shape having a three-dimensional mesh structure. In this case, the three-dimensional mesh structure refers to a structure similar to that of a resin foam having high water absorption property, such as a sponge. As illustrated in FIG. 2, the water absorbing humidifying material 4 includes the body portion 11 and the voids 10 opened in the body portion 11. It is conceivable that the water absorbing humidifying material 4 of Embodiment 1 be made of a porous material, such as a metal, ceramic, a resin, non-woven fabric, and a fiber, and each of these materials is formed into a foam or a mesh. However, the material of the water absorbing humidifying material 4 of Embodiment 1 is not limited to these materials.

When the water absorbing humidifying material 4 is made of a metal, there may be used, for example, a metal such as titanium, copper, and nickel, a precious metal such as gold, silver, and platinum, and an alloy such as a nickel alloy and a cobalt alloy. These kinds of the metals may be used alone, or in combination of two or more kinds. Among these kinds of metals, zinc, nickel, tin, chromium, copper, silver, and gold are preferred, because zinc, nickel, tin, chromium, copper, silver, and gold, which reduce the generation of a sparingly soluble substance, have excellent resistance to electric corrosion and electric abrasion, and retain the shape of the water absorbing humidifying material 4 over a long period of time to enable stable humidification.

When the water absorbing humidifying material 4 is made of ceramic, for example, alumina, zirconia, mullite, cordierite, silicon carbide, or other materials, may be used. However, the kinds of ceramic are not limited to these kinds as long as a material that absorbs water and has a capillary structure is employed.

When the water absorbing humidifying material 4 is made of a resin, polyethylene, polypropylene, an ethylene-vinyl acetate copolymer, or other materials may be used. However, the kinds of resin are not limited to these kinds as long as a material that absorbs water and has a capillary structure is employed.

When the water absorbing humidifying material 4 is made of fiber, as a material of the water absorbing humidifying material 4, acetate, polyester, nylon, or other materials may be used. However, the kinds of fiber are not limited to these kinds as long as a material and a structure that absorbs water is employed. Further, a fiber obtained by coating a porous substance made from a resin with metal powder may also be used.

The surface layer of the water absorbing humidifying material 4 may be subjected to hydrophilic treatment from the viewpoint of increasing the amount of the humidifying water 1 to be retained and preventing degradation of water absorption capability. The types of method of hydrophilic treatment are not limited as well. For example, the hydrophilic treatment may be performed by coating with a hydrophilic resin, or by corona discharge.

Figure 3:
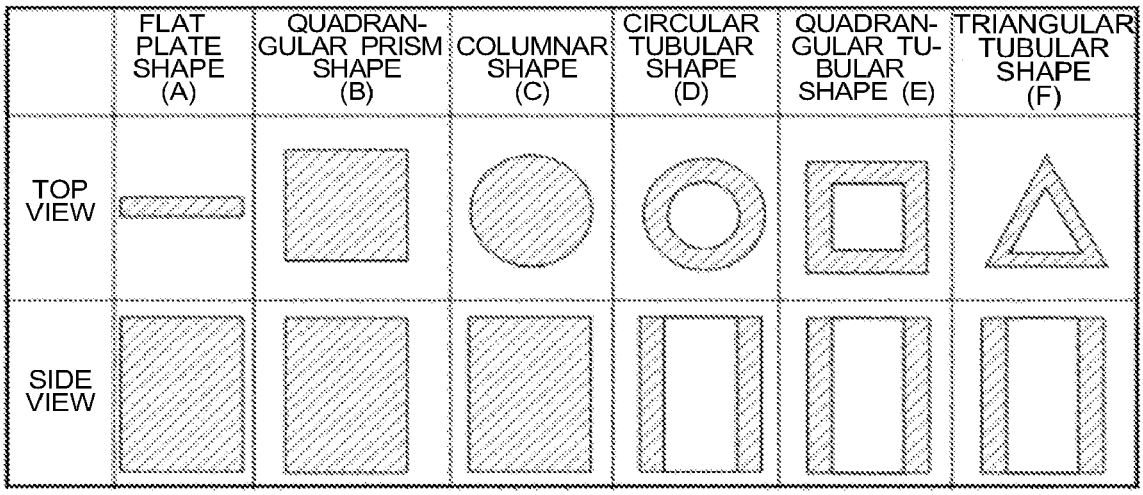
FIG. 3 is a schematic view for illustrating shapes of humidifying materials.

FIG. 3 is a schematic view for illustrating examples of the shape of the water absorbing humidifying material 4. The shape of the water absorbing humidifying material 4 is not particularly limited as well, and may be, for example, as illustrated in FIG. 3, a flat plate shape (A), a quadrangular prism shape (B), or a columnar shape (C). Further, the shape of the water absorbing humidifying material 4 may be a circular tubular shape (D), a quadrangular tubular shape (E), or a triangular tubular shape (F), which have a hollow inside, and only is required to be adjusted as appropriate depending on the size of the humidifier 9 to be manufactured.

The thickness of the water absorbing humidifying material 4 may be adjusted as appropriate depending on the size of the humidifier 9 to be manufactured. For example, a sheet-like water absorbing humidifying material 4 having a thickness of 0.5 mm or more and 2 mm or less may be manufactured and then processed into a desired shape by cutting. The processing method is not particularly limited, and for example, various methods such as wire cutting, laser cutting, press stamping, shaving, manual cutting and bending may be employed.

The water absorbing humidifying material 4 has a plurality of openings 5 opened to be penetrated through the water absorbing humidifying material 4 in a plate thickness direction of the water absorbing humidifying material 4 having a plate shape (short axis direction). The plurality of openings 5 are arrayed in the airflow direction perpendicular to the arraying direction in which the plurality of water absorbing humidifying materials 4 are arrayed (short axis direction). That is, the plurality of openings 5 are distributed on a flat surface portion of the water absorbing humidifying material 4.

In an example as illustrated in FIG. 1, the openings 5 are not present at a portion on the one end side, which is located in the vicinity of the air-sending device 8, of each of the water absorbing humidifying materials 4, but the plurality of openings 5 arrayed in two rows in the vertical direction are present at a portion on the other end side of each of the water absorbing humidifying materials 4. That is, the distribution density of the plurality of openings 5 is smaller on the portion on the one end side than the portion on the other end side of each of the water absorbing humidifying materials 4. In other words, an opening area obtained by the plurality of openings 5 in each of the water absorbing humidifying materials 4 is larger on the other end side than on the one end side. In this case, the openings 5 each refers to a portion of the water absorbing humidifying material 4 that is penetrated through the water absorbing humidifying material 4 in the plate thickness direction, and a shape of the openings 5 may be an irregular shape, such as a circular shape, a semicircular shape, a triangular shape, a quadrangular shape, a rhombic shape, an elliptical shape, a star shape, and a crescent shape. Further, when the plate thickness of the water absorbing humidifying material 4 is 0.5 mm or more and 2 mm or less, the area of each of the openings 5 is 0.2 $mm^2$ or more and 20 $mm^2$ or less, and is preferably 0.8 $mm^2$ or more and 13 $mm^2$ or less. When the openings 5 in the above-mentioned range are cut, the surface area of the water absorbing humidifying material 4 in which the openings 5 are cut is larger than the surface area of the water absorbing humidifying material 4 in which the openings 5 are not cut, thereby enhancing the vaporization and evaporation rate and the humidification performance. Further, when the openings 5 out of the above-mentioned range are cut, the surface area of the water absorbing humidifying material 4 in which the openings 5 are cut is smaller than the surface area of the water absorbing humidifying material 4 in which the openings 5 are not cut. Thus, the contact area with the air 7 is reduced, thereby degrading the vaporization and evaporation rate and the humidification performance.

The drain pan 6 is configured to receive the humidifying water 1 that is not evaporated from the water absorbing humidifying materials 4, and to discharge the humidifying water 1 through a drain outlet when a certain or more amount of the humidifying water 1 is accumulated.

The air-sending device 8 is configured to cause the air 7 to flow through the space, in which the water absorbing humidifying materials 4 are arrayed, from the one end side to the other end side of each of the water absorbing humidifying materials 4, and selection may appropriately be made from a sirocco fan, a propeller fan, a line flow fan, or other fan. The air 7 sent from the air-sending device 8 flows from the one end side to the other end side of each of the water absorbing humidifying materials 4 to be substantially parallel.

Figure 4:
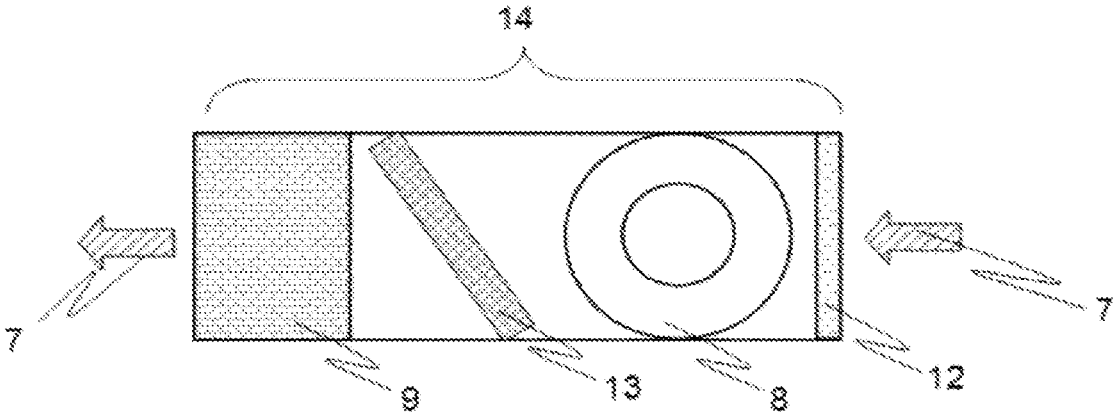
FIG. 4 is a configuration view for illustrating an example of an air-conditioning apparatus having the humidifier.

FIG. 4 is a configuration view for illustrating an example of an air-conditioning apparatus 14 in which the humidifier 9 according to Embodiment 1 is installed. As illustrated in FIG. 4, the air-conditioning apparatus 14 including the humidifier 9 according to Embodiment 1 includes the humidifier 9 including the air-sending device 8, a filter 12, and a heat exchanger 13. The humidifier 9 is placed on a leeward side of the heat exchanger 13, and is configured to humidify a space by causing the air 7 subjected to heat exchange in the heat exchanger 13 to flow through the humidifier 9.

(Operation of Humidifier)

Next, with reference to FIG. 1, FIG. 2, FIG. 3, and FIG. 4, operations of the humidifier 9 and the air-conditioning apparatus 14 including the humidifier 9 according to Embodiment 1 are described.

The humidifying water 1 reserved in the supply portion 2 is transported to the nozzles 3. The nozzles 3 each having the humidifying water 1 transported to the nozzle 3 is caused to drip the humidifying water 1 from above the one end side of each of the water absorbing humidifying materials 4 on a windward side of the water absorbing humidifying materials 4. In this manner, the humidifying water 1 is supplied to the water absorbing humidifying materials 4. The water absorbing humidifying materials 4 each have a capillary force, and the gravity of the humidifying water 1 can be utilized. Consequently, the humidifying water 1 is dispersed in the water absorbing humidifying material 4 through the voids 10 of the water absorbing humidifying material 4.

As illustrated in FIG. 1, the air 7 is caused to flow from the air-sending device 8 from the one end side on the windward side to the other end side on the leeward side of each of the water absorbing humidifying materials 4 to be parallel to surfaces of the water absorbing humidifying materials 4. In this manner, the air is caused to flow through the space in which the water absorbing humidifying materials 4 are arrayed. With this configuration, the air 7 is held in gas-liquid contact with the surfaces of the water absorbing humidifying materials 4. In this manner, the humidifying water 1 is evaporated to humidify the space.

Figure 5:
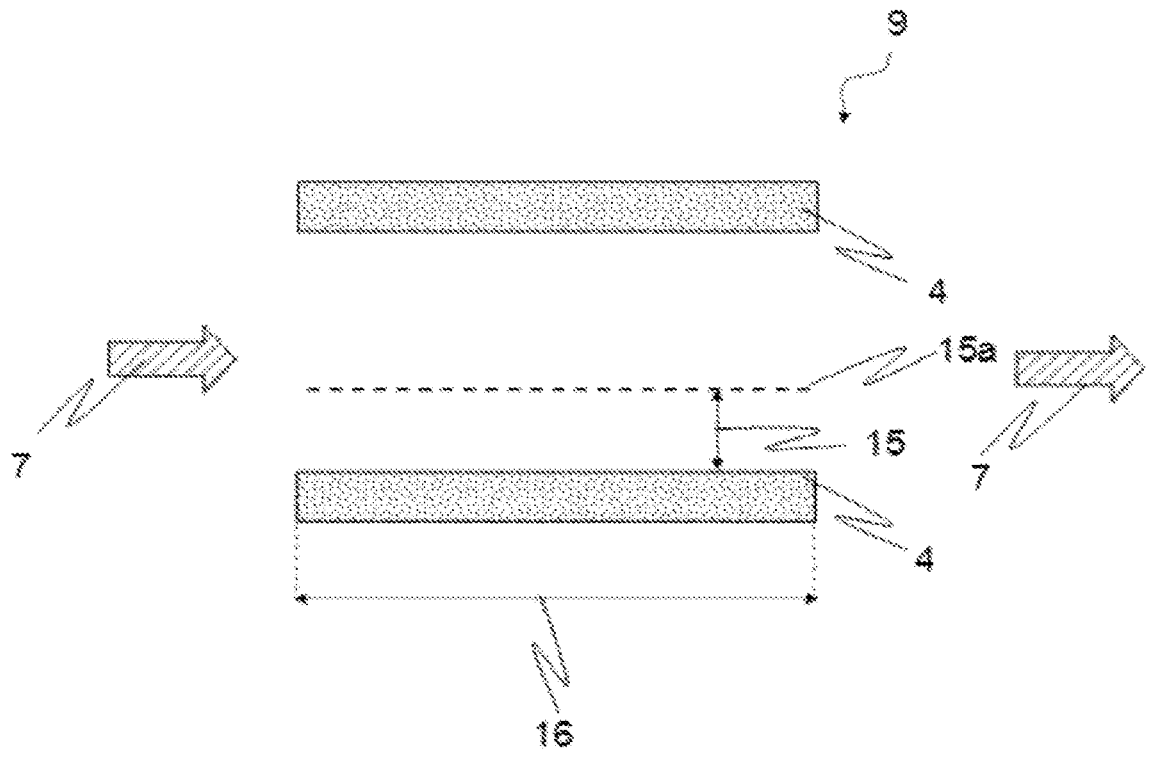
FIG. 5 is a schematic view for illustrating a mechanism of humidification.

FIG. 5 is a schematic view for illustrating a mechanism of humidification. A humidification mechanism by the water absorbing humidifying materials 4 is described with reference to FIG. 5.

A dispersing phenomenon of water vapor into air from the water absorbing humidifying materials 4 containing the humidifying water 1 is dominated by a dispersion speed Na. When a dispersion coefficient is represented by De, a water concentration (water contained amount) in the air 7 is represented by Ca, a water concentration (water contained amount) in the water absorbing humidifying material 4 is represented by Co, and a saturation boundary film thickness of the water vapor is represented by δ, the dispersion speed Na is determined by Expression (1).

$$Na=De\times(Co-Ca)/\delta \quad (1)$$

When a depth length 16 of the water absorbing humidifying material 4 is represented by L, the Prandtl number is represented by Pr, an air density is represented by ρ, and kinetic viscosity is represented by V, a saturation boundary film thickness δ of the water vapor at the time of laminar flow is determined by Expression (2).

$$\delta=L/(0.644\times Pr^{1/3}\times(\rho\times U\times L/V)^{1/2}) \quad (2)$$

With reference to the saturation boundary film equation of Expression (2), as air velocity U of the air 7 is increased, the saturation boundary film thickness δ of the water vapor is reduced. Thus, as the air velocity U of the air 7 is increased, the dispersion speed Na is increased as indicated by Expression (1), thereby enhancing the humidification performance.

The saturation boundary film thickness δ of the water absorbing humidifying material 4 is the thinnest on the one end side on the windward side in the airflow direction of the air 7. Thus, high humidification performance is exerted on the one end side including the flat surface portion on the windward side and the one end side of the water absorbing humidifying material 4. However, on the one end side, the humidification performance is higher than on the other end side, so that the vaporization and evaporation rate is also high. Thus, the one end side is a portion on which the precipitation of the scales is promoted most. Further, the saturation boundary film thickness δ on the leeward side of the water absorbing humidifying material 4 is large. Thus, low humidification performance is exerted on the other end side including the flat surface portion on the leeward side and the other end side of the water absorbing humidifying material 4. On the other end side, the humidification performance is lower than on the one end side, so that the vaporization and evaporation rate is also low. Thus, the other end side is a portion at which the precipitation of the scales is relatively less likely to be caused. That is, the precipitation amount of the scales is large on the one side, whereas the precipitation amount of the scales is small on the other side. Consequently, the precipitation amount of the scales is uneven in the entire water absorbing humidifying material 4. Consequently, even in a case in which the scales do not precipitate at a portion on the other end side of the water absorbing humidifying material 4, when the scales precipitate at a portion on the one end side of the water absorbing humidifying material 4, it is required to replace the water absorbing humidifying material 4, with the result that there is a fear in that a replacement cycle of the water absorbing humidifying material 4 may be shortened.

Figure 6:
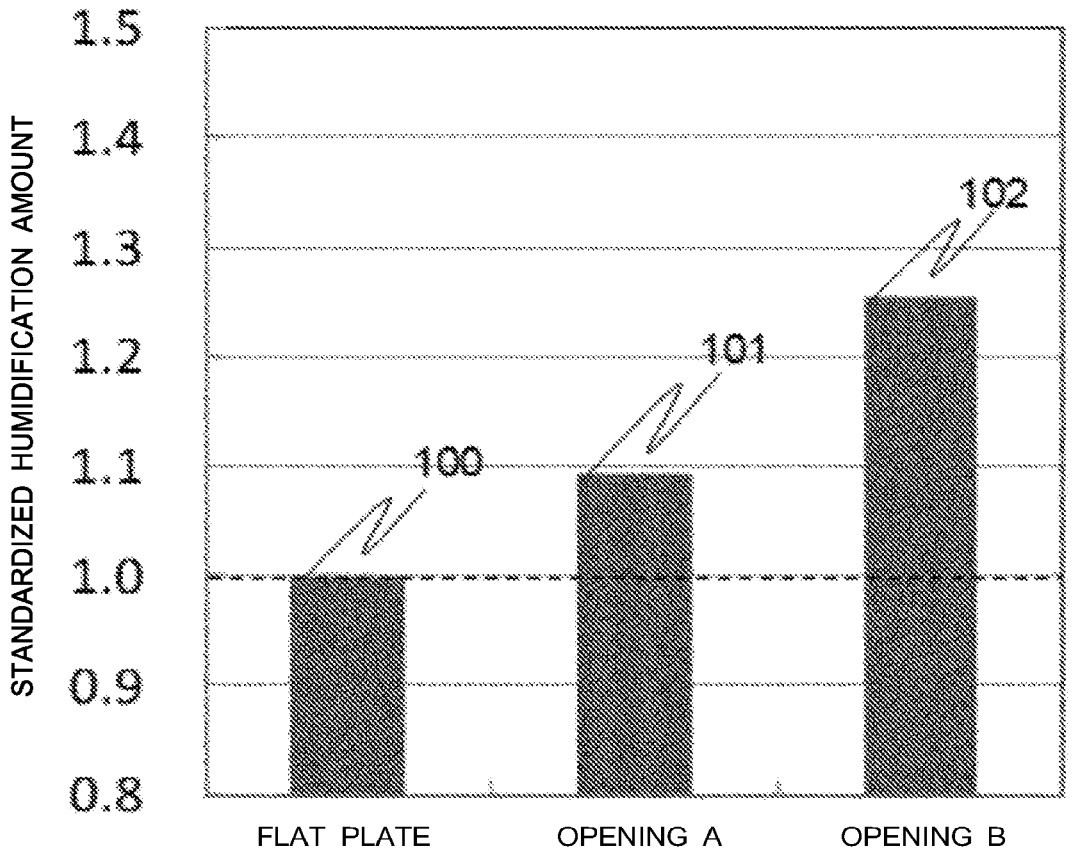
FIG. 6 is a graph for showing a humidification effect by openings.

The humidification performance when the openings 5 are cut in each of the water absorbing humidifying material 4 is described. In FIG. 6, there are shown results of humidification performance when the openings 5 each having a circular shape are cut in each of resin-made humidifying materials 100 having a flat plate shape. The resin-made humidifying materials are each made of polypropylene. Humidification performances of resin-made humidifying materials 100, resin-made humidifying materials 101, and resin-made humidifying materials 102 were measured under an evaluation condition described below, and fifteen humidifying materials were arranged at a pitch of 6 mm. Specifically, the resin-made humidifying material 100 had a flat plate shape, and had a height of 170 mm, a depth length of 30 mm, and a thickness of 1 mm. The resin-made humidifying material 101 with openings A was obtained by opening circular holes each having a diameter of 0.95 mm at a pitch of 3 mm in the resin-made humidifying material 100 having a flat plate shape as illustrated in FIG. 1. The resin-made humidifying material 102 with openings B was obtained by opening circular holes each having a diameter of 1.2 mm at a pitch of 3 mm in the resin-made humidifying material 100 having a flat plate shape as illustrated in FIG. 1.

In FIG. 6, a result in a case in which the humidification performance of the resin-made humidifying materials 100 each having a flat plate shape is standardized is shown. When the resin-made humidifying materials 101 with the openings A were used, as compared to humidification performance of 100% when the resin-made humidifying materials 100 without openings were used, the humidification performance was increased by 10%. On the other hand, when the resin-made humidifying materials 102 with the openings B were used, as compared to the humidification performance of 100% when the resin-made humidifying materials 100 without the openings were used, the humidification performance was increased by 26%. In this case, as a result of observation of the openings A of the resin-made humidifying materials 101 and the openings B of the resin-made humidifying materials 102 through a microscope, water films were formed on the openings A of the resin-made humidifying materials 101, but water films were not formed on the openings B of the resin-made humidifying materials 102 due to an influence of surface tension of the water, and the openings B of the resin-made humidifying materials 102 were penetrated. The surface area of the resin-made humidifying materials 102 with the openings B that were penetrated was increased by 10% as compared to the surface area of the resin-made humidifying materials 100 each having a flat plate shape without openings, and the humidification performance was increased by 26%. As a result of detailed analysis, it was found that, when the openings 5 of the water absorbing humidifying materials 4 containing the humidifying water 1 were penetrated, turbulence of the air 7 flowing through the vicinities of the water absorbing humidifying materials 4 was caused due to inflow and outflow at the openings 5, with the result that the vaporization and evaporation rate (substance movement) was enhanced.

The openings are cut in the flat plate surface of the water absorbing humidifying material 4 to be opened in the plate thickness direction of the water absorbing humidifying material 4. Thus, the humidification performance at the portion at which the humidification performance is low can be enhanced. Consequently, the openings 5 are cut in the water absorbing humidifying material 4 to have a distribution. Thus, the portion at which the scales precipitate can be controlled, and thereby the humidifying efficiency of the water absorbing humidifying material 4 can be uniformized.

As illustrated in FIG. 4, the air-conditioning apparatus 14 including the humidifier 9 sucks in the air 7 into the air-conditioning apparatus 14 by use of the air-sending device 8. Fine particles are contained in the air 7. Thus, the fine particles are collected at the filter 12, and the air 7 is heated or cooled at the heat exchanger 13. Then, the air 7 is caused to flow through the humidifier 9 to be humidified.

As described above, in the humidifier 9 and the air-conditioning apparatus 14 including the humidifier 9 according to Embodiment 1, the openings 5 that are non-uniformly distributed are cut in the flat surface portion on the leeward side of the water absorbing humidifying material 4, on which the humidifying efficiency is low, and thereby the humidifying efficiency of the water absorbing humidifying material 4 can be uniformized. Further, with the above-mentioned configuration, the scale can be caused to precipitate not only on the one end side including the flat surface portion on the windward side and the one end side, but also on the other end side including the flat surface portion on the leeward side and the other end side, and thereby a load can be applied also to the other end side. Consequently, it is possible to provide the humidifier 9 of which a frequency of replacement of the water absorbing humidifying material 4 can be reduced while the humidification performance is enhanced, and the air-conditioning apparatus 14 including the humidifier 9.

Embodiment 2

A humidifier 9 and an air-conditioning apparatus 14 including the humidifier 9 according to Embodiment 2 is described focusing on differences from Embodiment 1.

Figure 7:
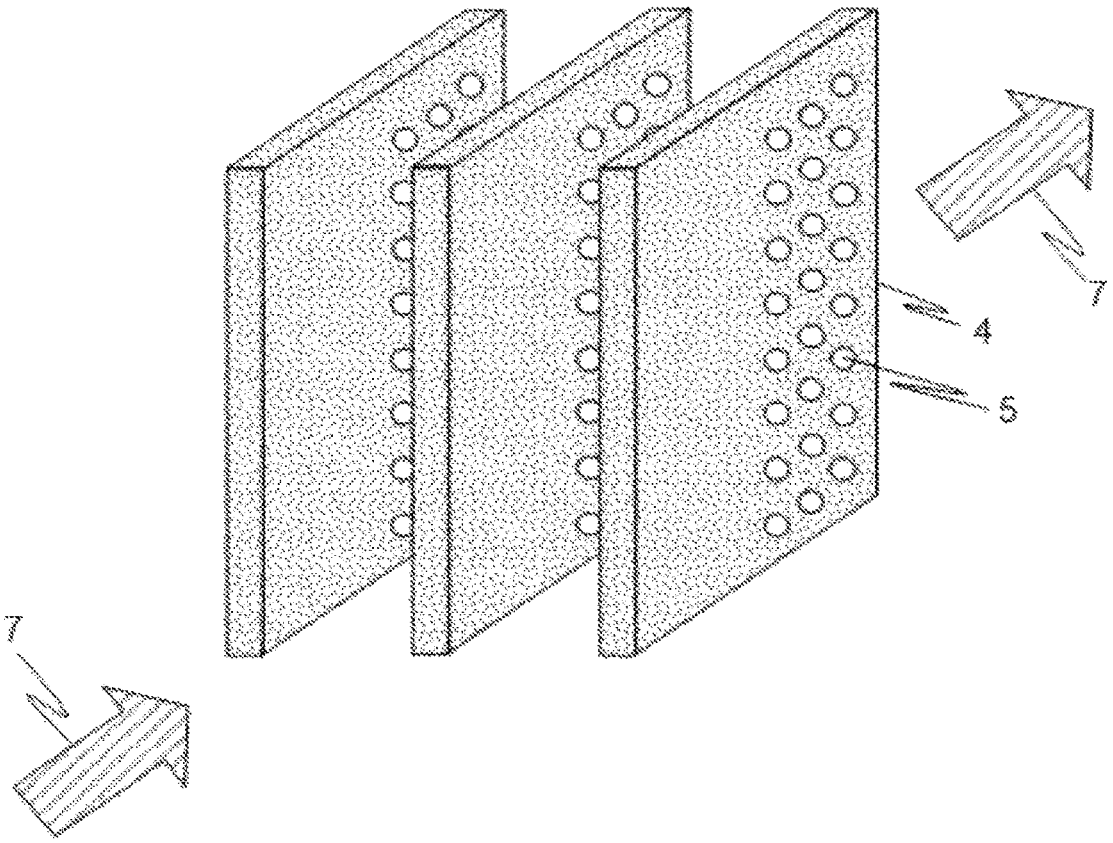
FIG. 7 is a configuration view of a humidifier according to Embodiment 2.

FIG. 7 is a configuration view of the water absorbing humidifying materials 4 of the humidifier 9 according to Embodiment 2 of the present invention. In FIG. 7, the plurality of openings 5 opened in the thickness direction of the water absorbing humidifying material 4 (short axis direction) are arrayed in three rows instead of two rows on the other end side including the flat surface portion and the other end side on the leeward side in the airflow direction of the air 7. Other configurations are the same as that of FIG. 1.

As described also in Embodiment 1, when the air 7 is to be caused to flow through the water absorbing humidifying materials 4, the air 7 to be caused to flow through the water absorbing humidifying materials 4 is the driest on the one end side of the water absorbing humidifying material 4 on the windward side. Consequently, the humidification performance per unit area is enhanced at the flat surface portion on the windward side. However, the concentration of the water (contained amount of the water) contained in the air 7 at the vicinity of the interface of the water absorbing humidifying material 4 is increased toward the leeward side along with the humidification effect, and hence the humidification performance per unit area at the flat surface portion on the leeward side is degraded. Consequently, scale components are liable to precipitate on the windward side, and the precipitation amount is reduced toward the leeward side. Consequently, to enhance the humidification performance per unit area on the other end side including the flat surface portion on the leeward side and the other end side of the water absorbing humidifying material 4, and to uniform the humidification performance and the vaporization and evaporation rate in the entire water absorbing humidifying material 4, the plurality of openings 5 are cut so that the distribution density of the openings 5 is high on the leeward side of the water absorbing humidifying material 4.

As illustrated in FIG. 7, the openings 5 may be cut in a matrix pattern, or further, may be cut in a staggered pattern. Further, the openings 5 may be cut so that the openings 5 of the adjacent water absorbing humidifying materials 4 are not overlapped with each other.

In practical use, the supply portion 2, the nozzles 3, the water absorbing humidifying materials 4, the air-sending device 8, and the drain pan 6 only are required to be fixed by, for example, the predetermined supporter. The configuration of the supporter is not particularly limited, and only is required to be selected as appropriate depending on the usage of the humidifier 9.

Operations of the humidifier 9 and the air-conditioning apparatus 14 including the humidifier 9 according to Embodiment 2 are the same as those of Embodiment 1, and hence description of the same operations is omitted.

As described above, the distribution density of the openings 5 is reduced on the windward side of the water absorbing humidifying material 4, and is increased on the leeward side. Thus, the humidification performance and the vaporization and evaporation rate at the region on the leeward side, at which the humidification performance per unit area and the vaporization and evaporation rate are low in the related art, can be enhanced. Consequently, the scales that locally precipitate at the flat surface portion or the one end side on the windward side of the water absorbing humidifying material 4 can be caused to precipitate also on the leeward side. Thus, the surface load of the water absorbing humidifying material 4 caused by the scales that precipitate can be uniformized to the extent possible, and thereby a replacement cycle of the water absorbing humidifying material 4 can be extended.

Embodiment 3

A humidifier 9 and an air-conditioning apparatus 14 including the humidifier 9 according to Embodiment 3 is described focusing on differences from Embodiment 3.

Figure 8:
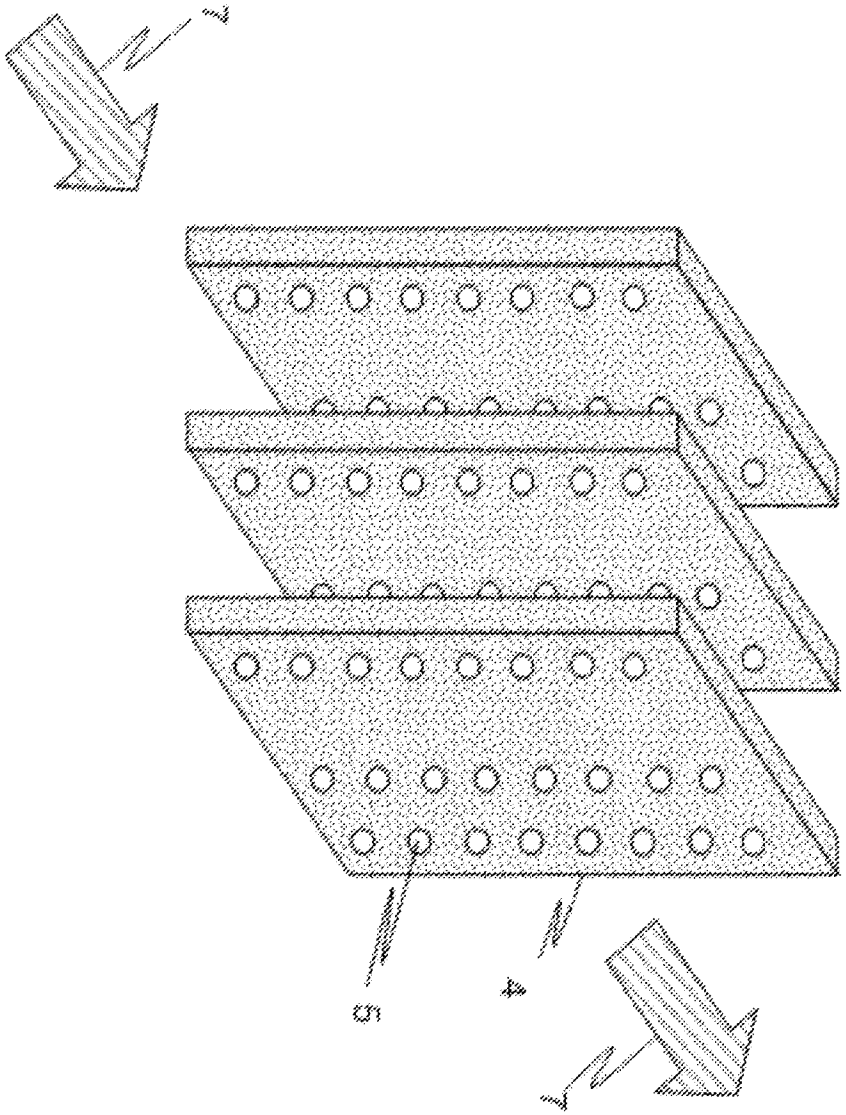
FIG. 8 is a configuration view of a humidifier according to Embodiment 3.

FIG. 8 is a configuration view of the water absorbing humidifying materials 4 of the humidifier 9 according to Embodiment 3 of the present invention. In FIG. 8, the plurality of openings 5 are cut so that an interval of the openings 5 that are adjacent to each other in the airflow direction is large on the one end side of the water absorbing humidifying material 4 and is small on the other end side of the water absorbing humidifying material 4. That is, in the plurality of openings 5, an interval of the openings 5 adjacent to each other on the other end side is shorter than the interval of the openings 5 adjacent to each other on the one end side.

The air 7 flows into and flows out from the openings 5 of the water absorbing humidifying material 4, and thus the vaporization and evaporation rate is enhanced. To enhance the vaporization and evaporation rate on the leeward side of the water absorbing humidifying material 4 and to uniform the scale precipitation in the entire water absorbing humidifying material 4, the interval of the openings 5 adjacent to each other on the leeward side is smaller than the interval of the openings 5 adjacent to each other on the windward side.

The openings 5 may be cut in a matrix pattern, or further, may be cut in a staggered pattern. Further, the openings 5 of one water absorbing humidifying material 4 and the openings 5 of an adjacent water absorbing humidifying material 4 can be cut not to overlap with each other.

In Embodiment 3, the supply portion 2, the nozzles 3, the water absorbing humidifying materials 4, the air-sending device 8, and the drain pan 6 only are required to be fixed by, for example, the predetermined supporter. The configuration of the supporter is not particularly limited, and only is required to be selected as appropriate depending on the usage of the humidifier 9.

Operations of the humidifier 9 and the air-conditioning apparatus 14 including the humidifier 9 according to Embodiment 3 are the same as those of Embodiment 1, and hence description of the same operation is omitted.

As described above, the interval of the adjacent openings 5 is increased on the windward side of the water absorbing humidifying material 4, and is reduced on the leeward side. Thus, the humidification performance and the vaporization and evaporation rate at the region on the leeward side, at which the humidification performance per unit area and the vaporization and evaporation rate are low in the related art, can be enhanced. Consequently, the scales that locally precipitate at the flat surface portion or the one end side on the windward side of the water absorbing humidifying material 4 can be caused to precipitate also on the leeward side. Thus, the surface load of the water absorbing humidifying material 4 caused by the scales that precipitate can be uniformized to the extent possible, and thereby a replacement cycle of the water absorbing humidifying material 4 can be extended.

Embodiment 4

A humidifier 9 and an air-conditioning apparatus 14 including the humidifier 9 according to Embodiment 4 is described by focusing on differences from Embodiment 1.

Figure 9:
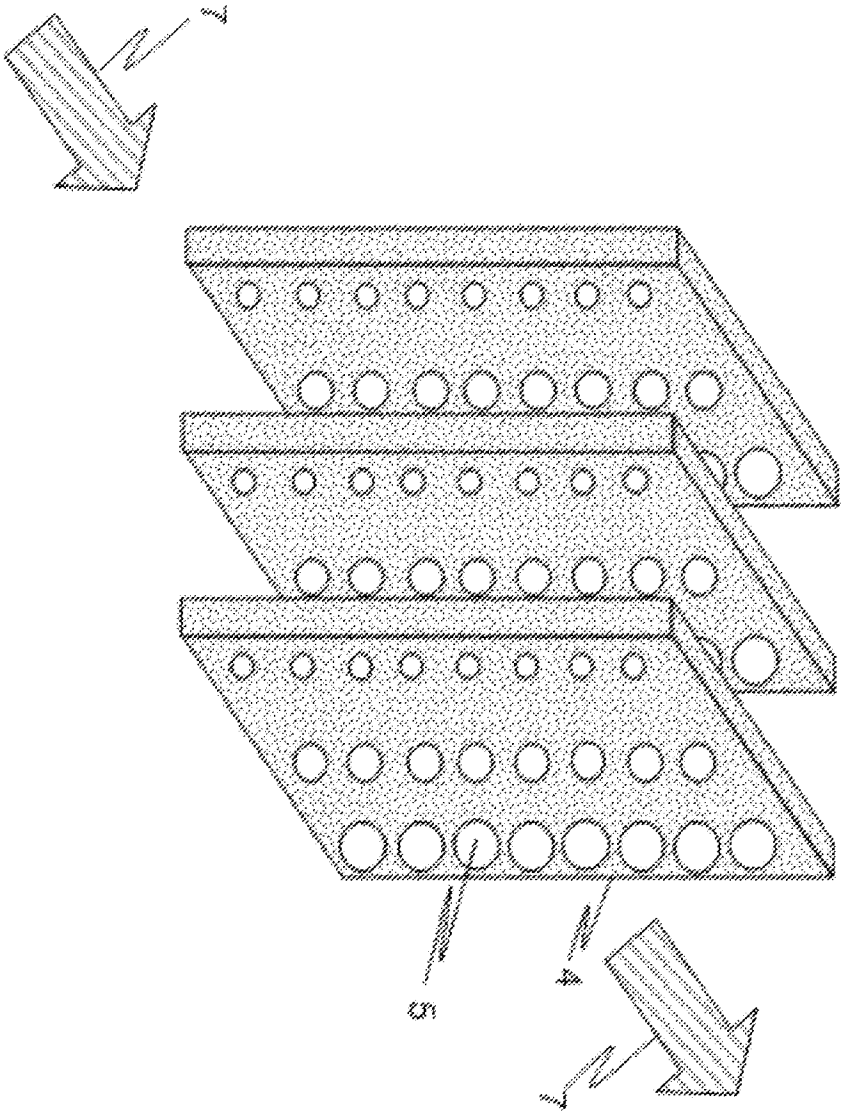
FIG. 9 is a configuration view of a humidifier according to Embodiment 4.

FIG. 9 is a configuration view of the water absorbing humidifying materials 4 of the humidifier 9 according to Embodiment 4 of the present invention. In FIG. 9, the opening areas of the plurality of openings 5 arrayed in the airflow direction are increased from the one end side to the other end side of each of the water absorbing humidifying materials 4, that is, from the windward side to the leeward side in the airflow direction of the air 7. In other words, among the plurality of openings 5, the opening area of one of the openings 5 located on the other end side is larger than the opening area of one of the openings 5 located on the one end side.

The air 7 flows into and flows out from the openings 5 of the water absorbing humidifying material 4, and thus the vaporization and evaporation rate is enhanced. As the opening area of one of the openings 5 is increased, turbulence of the air 7 flowing into the openings 5 is caused, and hence the vaporization and evaporation rate is enhanced. Consequently, to enhance the humidification performance and the vaporization and evaporation rate on the leeward side of the water absorbing humidifying material 4, on which the humidification performance per unit area and the vaporization and evaporation rate are low, the opening area of one of the openings 5 opened in the plate thickness direction of the water absorbing humidifying material 4 is increased from the windward side to the leeward side along the airflow direction of the air 7, which is directed from the one end side to the other end side of the water absorbing humidifying material 4.

The openings 5 may be cut in a matrix pattern, or further, may be cut in a staggered pattern. Further, the openings 5 of one water absorbing humidifying material 4 and the openings 5 of the adjacent water absorbing humidifying material 4 can be cut not to overlap with each other.

In Embodiment 4, the supply portion 2, the nozzles 3, the water absorbing humidifying materials 4, the air-sending device 8, and the drain pan 6 only are required to be fixed by, for example, the predetermined supporter. The configuration of the supporter is not particularly limited, and only is required to be selected as appropriate depending on the usage of the humidifier 9.

Operations of the humidifier 9 and the air-conditioning apparatus 14 including the humidifier 9 according to Embodiment 4 are the same as those of Embodiment 1, and hence description of the same operations is omitted.

As described above, the opening areas of the openings 5 that are arranged are increased from the windward side to the leeward side of the water absorbing humidifying material 4. Thus, it is possible to enhance the humidification performance and the vaporization and evaporation rate at the region on the leeward side, at which the humidification performance per unit area and the vaporization and evaporation rate are low in the related art. Consequently, the scales that locally precipitate at the flat surface portion or the one end side on the windward side of the water absorbing humidifying material 4 can be caused to precipitate also on the leeward side. Thus, the surface load of the water absorbing humidifying material 4 caused by the scales that precipitate can be uniformized to the extent possible, and thereby replacement cycles of the water absorbing humidifying material 4 can be extended.

The present invention is not limited to the specific details as mentioned and described above and the representative embodiments. Modified examples and effects easily derived by a person skilled in the art are also included in the present invention. Thus, various changes may be made without departing from the spirit or scope of the general concept of the present invention defined by the scope of claims and equivalents of the claims.

REFERENCE SIGNS LIST

| | |
|---|---|
| 1 | humidifying water |
| 2 | supply portion |

-continued

| | |
|---|---|
| 3 | nozzle |
| 4 | water absorbing humidifying material |
| 5 | opening |
| 6 | drain pan |
| 7 | air |
| 8 | air-sending device |
| 9 | humidifier |
| 10 | void |
| 11 | body portion |
| 12 | filter |
| 13 | heat exchanger |
| 14 | air-conditioning apparatus |

The invention claimed is:

1. A humidifier, comprising:

a water absorbing humidifying material having a plate shape and made of a water absorbing material;

a supply unit configured to supply water to an upper portion on a windward side of the water absorbing humidifying material; and an air-sending device configured to send air from one end side to an other end side of the water absorbing humidifying material in an airflow direction perpendicular to a plate thickness direction of the water absorbing humidifying material, wherein the water absorbing humidifying material made of the water absorbing material has surfaces on which the air is sent in the airflow direction from the one end side to the other end side, has a plurality of openings penetrating through the water absorbing humidifying material, and is configured to vaporize or evaporate the absorbing water supplied from the supply unit by the air sent from the air-sending device, the plurality of openings having a non-uniform distribution density.

2. The humidifier of claim 1, wherein opening areas of the plurality of openings on the water absorbing humidifying material are larger on the other end side than on the one end side.

3. The humidifier of claim 2, wherein, among the plurality of openings, an interval of openings adjacent to each other on the other end side is shorter than an interval of openings adjacent to each other on the one end side.

4. The humidifier of claim 2, wherein, among the plurality of openings, an opening area of one opening located on the other end side is larger than an opening area of one opening located on the one end side.

5. The humidifier of claim 1, wherein an opening area of each one of the plurality of openings is 0.8 mm2 or more and 13 mm2 or less.

6. The humidifier of claim 1, wherein the water absorbing humidifying material has a hydrophilic coating portion subjected to hydrophilic treatment on a surface of the water absorbing humidifying material.

7. An air-conditioning apparatus, comprising:

a heat exchanger configured to subject air sent to heat exchange; and the humidifier of claim 1, the air-conditioning apparatus being configured to execute air conditioning in such a manner that the humidifier humidifies the air subjected to the heat exchange by the heat exchanger.

* * * * *